US010574002B1

(12) United States Patent
Henry et al.

(10) Patent No.: US 10,574,002 B1
(45) Date of Patent: Feb. 25, 2020

(54) LEAD FRAME MODULE FOR ELECTRICAL CONNECTOR

(71) Applicant: TE CONNECTIVITY CORPORATION, Berwyn, PA (US)

(72) Inventors: Randall Robert Henry, Lebanon, PA (US); Michael Joseph Tryson, Spring Grove, PA (US); Michael John Phillips, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/166,276

(22) Filed: Oct. 22, 2018

(51) Int. Cl.

| | |
|---|---|
| ***H01R 13/6597*** | (2011.01) |
| ***H01R 13/502*** | (2006.01) |
| ***H01R 13/405*** | (2006.01) |
| ***H01R 13/6587*** | (2011.01) |

(52) U.S. Cl.
CPC ..... *H01R 13/6597* (2013.01); *H01R 13/405* (2013.01); *H01R 13/502* (2013.01); *H01R 13/6587* (2013.01)

(58) Field of Classification Search
CPC ..... H01R 13/6597; H01R 13/502; H01R 13/405; H01R 13/6587; H01R 13/65807; H01R 13/658; H01R 13/6585; H01R 23/688; H01R 23/7073
USPC .. 439/92, 108, 497, 607.05, 607.08, 607.09, 439/607.11, 931
See application file for complete search history.

(56) References Cited

U.S. PATENT DOCUMENTS

| | | | | |
|---|---|---|---|---|
| 4,836,791 | A * | 6/1989 | Grabbe | H01R 23/6873 439/108 |
| 6,183,301 | B1 * | 2/2001 | Paagman | H01R 23/688 439/567 |
| 6,565,387 | B2 | 5/2003 | Cohen | |
| 6,638,079 | B1 * | 10/2003 | Billman | H01R 13/514 439/76.1 |
| 7,887,371 | B2 * | 2/2011 | Kenny | H01R 13/6625 439/620.22 |
| 8,382,524 | B2 * | 2/2013 | Khilchenko | H01R 13/6616 439/620.09 |
| 8,747,158 | B2 * | 6/2014 | Szczesny | H01R 4/04 439/607.07 |
| 9,048,583 | B2 * | 6/2015 | Johnescu | H01R 13/514 |
| 10,403,565 | B1 | 9/2019 | Henry et al. | |
| 2006/0166551 | A1 | 7/2006 | Korsunsky et al. | |
| 2016/0064869 | A1 | 3/2016 | Yu et al. | |
| 2016/0118750 | A1 | 4/2016 | Guo et al. | |
| 2016/0294121 | A1 | 10/2016 | Daughtry, Jr. et al. | |

(Continued)

*Primary Examiner* — Gary F Paumen

(57) ABSTRACT

A lead frame module includes a lead frame including ground conductors and signal conductors interleaved with the ground conductors side-by-side. The ground and signal conductors have transition portions extending between mating ends and terminating ends. A dielectric holder supports the lead frame and at least partially surrounds the transition portions of the ground and signal conductors. The dielectric holder has a first side and a second side with wells in the first side open to the transition portions of the ground conductors. A printed metal layer is formed in situ on the first side of the dielectric holder and at least partially fills the wells and engages the ground conductors in the wells to electrically connect to the ground conductors. The printed metal layer electrically connect a plurality of the ground conductors.

20 Claims, 5 Drawing Sheets

(56) References Cited

U.S. PATENT DOCUMENTS

| | | | | |
|---|---|---|---|---|
| 2018/0076581 | A1 | 3/2018 | Tsai et al. | |
| 2018/0115118 | A1 | 4/2018 | Zhao | |
| 2018/0115119 | A1 | 4/2018 | Little et al. | |
| 2018/0145462 | A1 | 5/2018 | Feng et al. | |
| 2018/0337483 | A1* | 11/2018 | Henry | H01R 13/40 |

* cited by examiner

LEAD FRAME MODULE FOR ELECTRICAL CONNECTOR

BACKGROUND OF THE INVENTION

The subject matter herein relates generally to electrical connectors with lead frame modules that provide shielded signal conductors.

Some electrical connectors include signal conductors held in discrete packages, referred to as contact modules or wafers, which are laterally stacked side by side within a connector housing. The electrical connectors may include ground conductors disposed between the signal conductors in order to reduce crosstalk between the signal conductors, and thereby improve signal integrity and connector performance relative to connectors that lack intervening ground shields. The electrical characteristics may be further improved by electrically connecting the ground shields along opposite sides of the contact modules to electrically common the ground shields.

Some electrical connectors are designed to include ground shields having skewers that extend across the contact modules through defined openings in the contact modules to allow the ground skewers to mechanically engage the ground conductors or another ground shield along the opposite side of the contact modules. However, designing and/or assembling an electrical connector with such ground skewers to electrically common the ground shields may increase the complexity and cost of the electrical connector due to additional parts, tooling, and labor relative to connectors that lack ground skewers. Reliability of the electrical connectors may also suffer because it may be difficult to ensure that the ground skewers align with openings of the contact modules and engage the ground conductors or the opposite ground shield.

A need remains for an electrical connector that efficiently and reliably provides sufficient electrical shielding for the signal conductors to improve signal integrity.

BRIEF DESCRIPTION OF THE INVENTION

In one or more embodiments of the present disclosure, a lead frame module of an electrical connector is provided. The lead frame module includes a lead frame including ground conductors and signal conductors interleaved with the ground conductors side-by-side. The ground and signal conductors have transition portions extending between mating ends and terminating ends. A dielectric holder supports the lead frame and at least partially surrounds the transition portions of the ground and signal conductors. The dielectric holder has a first side and a second side with wells in the first side open to the transition portions of the ground conductors. A printed metal layer is formed in situ on the first side of the dielectric holder and at least partially fills the wells and engages the ground conductors in the wells to electrically connect to the ground conductors. The printed metal layer electrically connect a plurality of the ground conductors.

In one or more embodiments of the present disclosure, a module assembly of an electrical connector is provided including upper and lower sub-assemblies. The upper sub-assembly includes an upper lead frame, an upper dielectric holder holding the upper lead frame and an upper printed metal layer formed in situ on the upper dielectric holder. The upper lead frame includes upper ground conductors and upper signal conductors interleaved with the upper ground conductors. The upper ground conductors and the upper signal conductors are disposed side-by-side. The upper ground conductors have transition portions extending between mating ends and terminating ends. The upper signal conductors have transition portions extending between mating ends and terminating ends. The upper dielectric holder have a first side and a second side with upper wells on the first side open to the transition portions of the upper ground conductors. The upper printed metal layer is formed on the first side of the upper dielectric holder. The upper printed metal layer at least partially fills the wells and engages the upper ground conductors in the wells to electrically connect to the upper ground conductors. The upper printed metal layer electrically connects a plurality of the upper ground conductors. The lower sub-assembly includes an lower lead frame, an lower dielectric holder holding the lower lead frame and an lower printed metal layer formed in situ on the lower dielectric holder. The lower lead frame includes lower ground conductors and lower signal conductors interleaved with the lower ground conductors. The lower ground conductors and the lower signal conductors are disposed side-by-side. The lower ground conductors have transition portions extending between mating ends and terminating ends. The lower signal conductors have transition portions extending between mating ends and terminating ends. The lower dielectric holder have a first side and a second side with lower wells on the first side open to the transition portions of the lower ground conductors. The lower printed metal layer is formed on the first side of the lower dielectric holder. The lower printed metal layer at least partially fills the wells and engages the lower ground conductors in the wells to electrically connect to the lower ground conductors. The lower printed metal layer electrically connects a plurality of the lower ground conductors. The first side of the upper dielectric holder faces the first side of the lower dielectric holder such that the upper printed metal layer faces the lower printed metal layer.

In one or more embodiments of the present disclosure, an electrical connector is provided including a housing and a lead frame module. The housing includes a mating end and a slot at the mating end receiving a mating electrical component. The housing has a cavity. The lead frame module is received in the cavity. The lead frame module includes a lead frame including ground conductors and signal conductors interleaved with the ground conductors side-by-side. The ground and signal conductors have transition portions extending between mating ends and terminating ends. The mating ends of the ground conductors and the mating ends of the signal contacts are positioned in the slot for mating with the mating electrical component. A dielectric holder supports the lead frame and at least partially surrounds the transition portions of the ground and signal conductors. The dielectric holder has a first side and a second side with wells in the first side open to the transition portions of the ground conductors. A printed metal layer is formed in situ on the first side of the dielectric holder and at least partially fills the wells and engages the ground conductors in the wells to electrically connect to the ground conductors. The printed metal layer electrically connect a plurality of the ground conductors.

DETAILED DESCRIPTION OF THE INVENTION

Embodiments of the present disclosure provide an electrical connector that includes a lead frame module. The lead frame module is configured to provide better electrical shielding around the signal conductors than known electrical connectors, thereby improving signal integrity. For example, embodiments of the electrical connector may offer improved electrical isolation between signal conductors of the lead frame module and other lead frame modules. Embodiments of the electrical connector may be configured to provide high speed signal transmission. Embodiments of the electrical connector described herein may be less costly and/or complex than known electrical connectors that install ground skewers through openings in contact modules to electrically connect ground shields.

Figure 1:
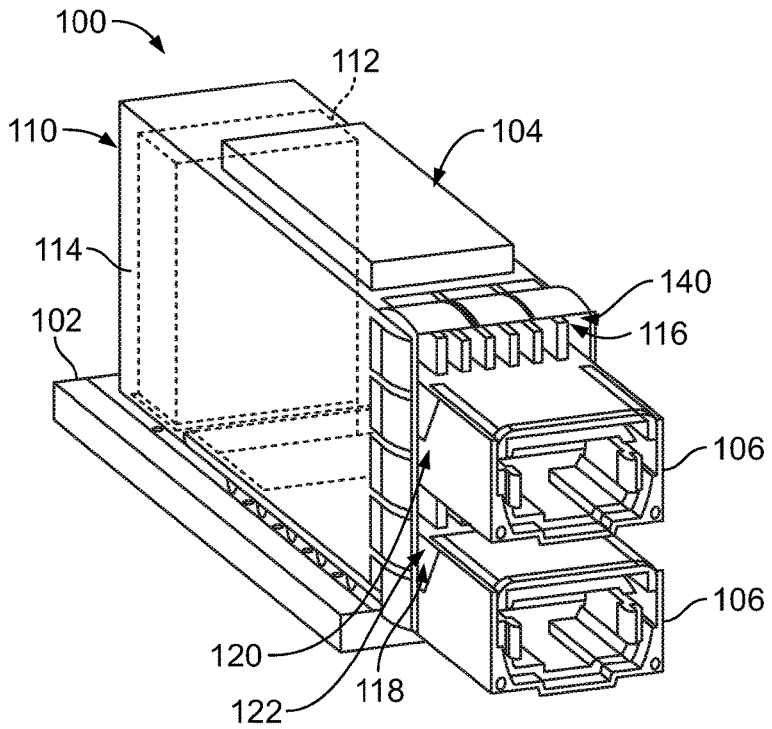
FIG. 1 is a front perspective view of a communication system formed in accordance with an exemplary embodiment.

FIG. 1 is a front perspective view of a communication system 100 formed in accordance with an exemplary embodiment. The communication system includes a host circuit board 102 and a receptacle connector assembly 104 mounted to the host circuit board 102. Pluggable modules 106 are configured to be electrically connected to the receptacle connector assembly 104. The pluggable modules 106 are electrically connected to the host circuit board 102 through the receptacle connector assembly 104. In various embodiments, the pluggable modules 106 are input/output (I/O) transceiver modules configured to transmit information in the form of electrical signals and/or optical signals.

In an exemplary embodiment, the receptacle connector assembly 104 includes a receptacle cage 110 and one or more electrical connectors 112 adjacent the receptacle cage 110. For example, in the illustrated embodiment, the electrical connector 112 is received in the receptacle cage 110. In other various embodiments, the electrical connector 112 may be located rearward of the receptacle cage 110. In various embodiments, the receptacle cage 110 is enclosed and provides electrical shielding for the electrical connector 112. The pluggable modules 106 are loaded into the receptacle cage 110 and are at least partially surrounded by the receptacle cage 110. In an exemplary embodiment, the receptacle cage 110 is a shielding, stamped and formed cage member that includes a plurality of shielding walls 114 that define one or more module channels for receipt of corresponding pluggable modules 106. In other embodiments, the receptacle cage 110 may be open between frame members to provide cooling airflow for the pluggable modules 106 with the frame members of the receptacle cage 110 defining guide tracks for guiding loading of the pluggable modules 106 into the receptacle cage 110. In other various embodiments, the receptacle connector assembly 104 is provided without the receptacle cage 110, instead just including the electrical connector 112.

In the illustrated embodiment, the receptacle cage 110 constitutes a stacked cage member having an upper module channel 116 and a lower module channel 118. The receptacle cage 110 has upper and lower module ports 120, 122 that open to the module channels 116, 118 that receive the pluggable modules 106. Any number of module channels may be provided in various embodiments. In the illustrated embodiment, the receptacle cage 110 includes the upper and lower module channels 116, 118 arranged in a single column, however, the receptacle cage 110 may include multiple columns of ganged module channels 116, 118 in alternative embodiments (for example, 2×2, 3×2, 4×2, 4×3, etc.). The receptacle connector assembly 104 is configured to mate with the pluggable modules 106 in both stacked module channels 116, 118. Optionally, multiple electrical connectors 112 may be arranged within the receptacle cage 110, such as when multiple columns of module channels 116, 118 are provided and/or multiple rows of module channels 116, 118 are provided.

In an exemplary embodiment, the electrical connector 112 is received in a cavity 140 of the receptacle cage 110, such as proximate to a rear wall of the receptacle cage 110. However, in alternative embodiments, the electrical connector 112 may be located behind the receptacle cage 110. In an exemplary embodiment, a single electrical connector 112 is used to electrically connect with the pair of stacked pluggable modules 106 in the upper and lower module channels 116, 118. In alternative embodiments, the communication system 100 may include discrete, stacked electrical connectors 112 (for example, an upper electrical connector and a lower electrical connector) for mating with the corresponding pluggable modules 106.

In an exemplary embodiment, the pluggable modules 106 are loaded through the front of the receptacle cage 110 to mate with the electrical connector 112. The walls 114 of the receptacle cage 110 provide electrical shielding around the electrical connector 112 and the pluggable modules 106, such as around the mating interfaces between the electrical connector 112 and the pluggable modules 106.

Figure 2:
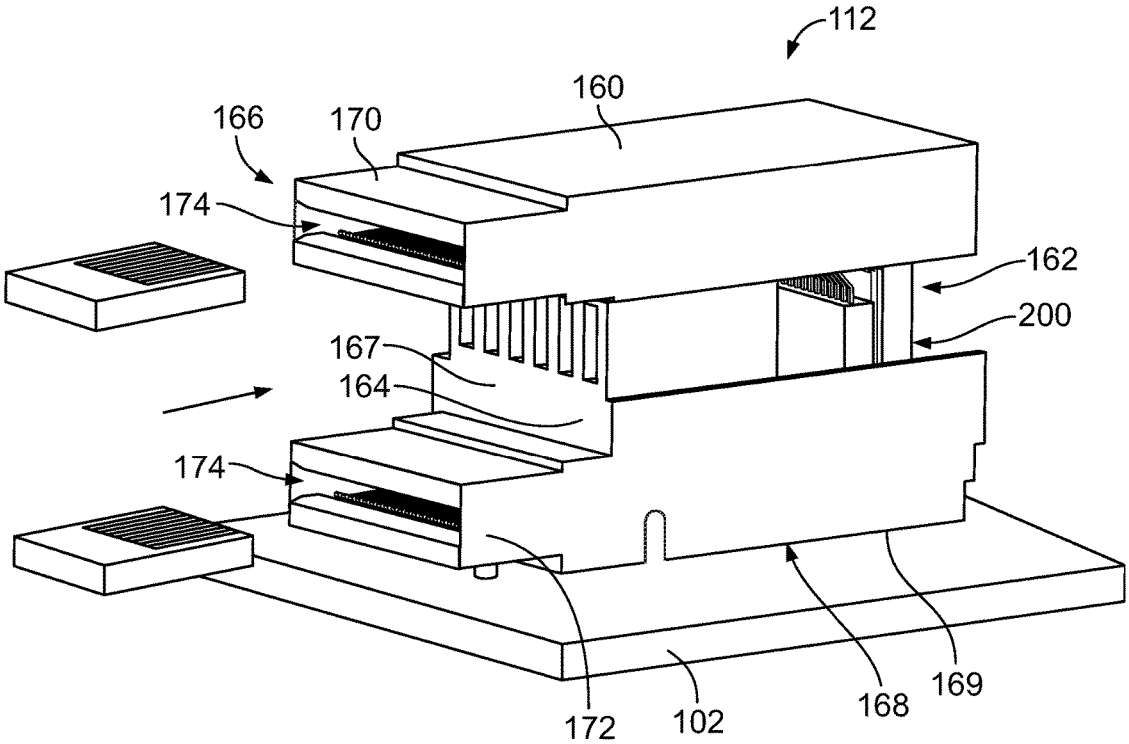
FIG. 2 is a front perspective view of an electrical connector of the communication system in accordance with an exemplary embodiment.

FIG. 2 is a front perspective view of the electrical connector 112 in accordance with an exemplary embodiment. The electrical connector 112 includes a housing 160 holding one or more lead frame modules 200 in a contact chamber 162 of the housing 160. The housing 160 may structurally support the lead frame modules 200 and retain the lead frame modules 200 in a fixed position relative to the housing 160. The housing 160 may also provide electrical insulation and/or protection for the lead frame modules 200 against debris, external impacts, and the like.

The housing 160 is defined by a body portion 164 having a mating end 166, such as at a front 167 of the body portion 164, and a mounting end 168, such as at a bottom 169 of the housing 160. In the illustrated embodiment, the electrical connector 112 is a right angle connector such that a plane of the mating end 166 is oriented perpendicular to a plane of the mounting end 168. Due to the right angle orientation, the mating electrical components are configured to be mated in a mating direction that is parallel to a surface of the host circuit board 102. In an alternative embodiment, the electrical connector 112 may be an in-line connector such that the mating end 166 and the mounting end 168 are at opposite ends of the housing 160, and the mating electrical components are mated in a mating direction that is perpendicular to the surface of the host circuit board 102.

The body portion 164 may be closed forward of the contact chamber 162. The contact chamber 162 may be open at the rear and/or the bottom to receive the lead frame modules 200. The body portion 164 may be molded from a dielectric material, such as a plastic material, to form the housing 160. The housing 160 may be open at the bottom or the rear to receive the lead frame modules 200.

Upper and lower shrouds 170 and 172 extend from the body portion 164 to define a stepped mating face. The shrouds 170, 172 are extension portions at the front of the housing 160. For a single port cage member, the electrical connector 112 may only include a single shroud 172. Mating slots 174, such as circuit card receiving slots, are provided in each of the shrouds 170, 172 to receive mating electrical components, such as plug connectors, card edges of circuit cards of the corresponding pluggable modules 106 (shown in FIG. 1), or another type of mating electrical component. A plurality of contacts (not shown) are exposed within the mating slots 174 for mating with contact pads on the card edge of the corresponding pluggable module 106. The contacts are configured to be electrically connected to the host circuit board 102. The contacts may be overmolded lead frames in various embodiments.

Figure 3:
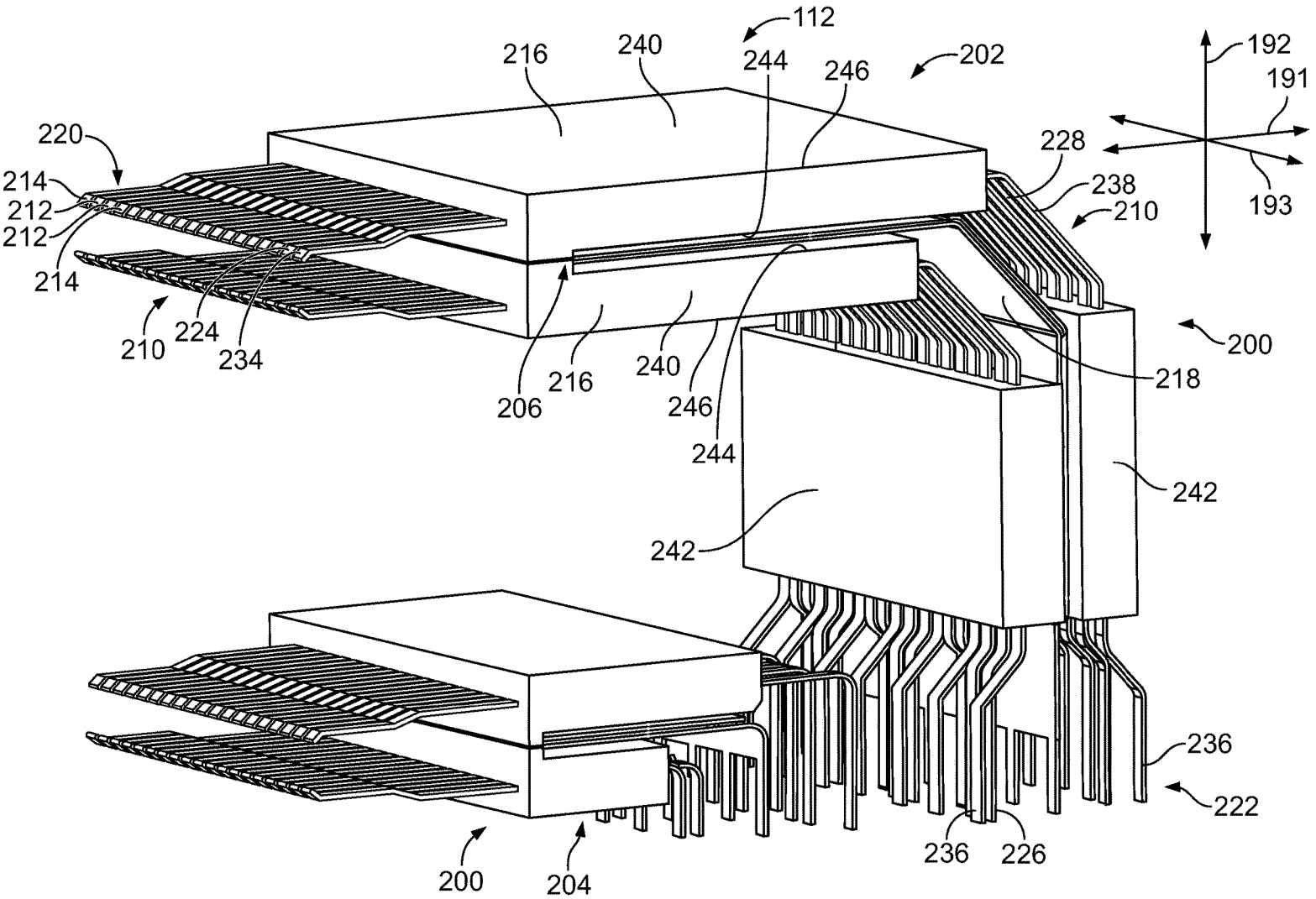
FIG. 3 is a perspective view of a portion of the electrical connector in accordance with an exemplary embodiment showing lead frame modules thereof.
Figure 4:
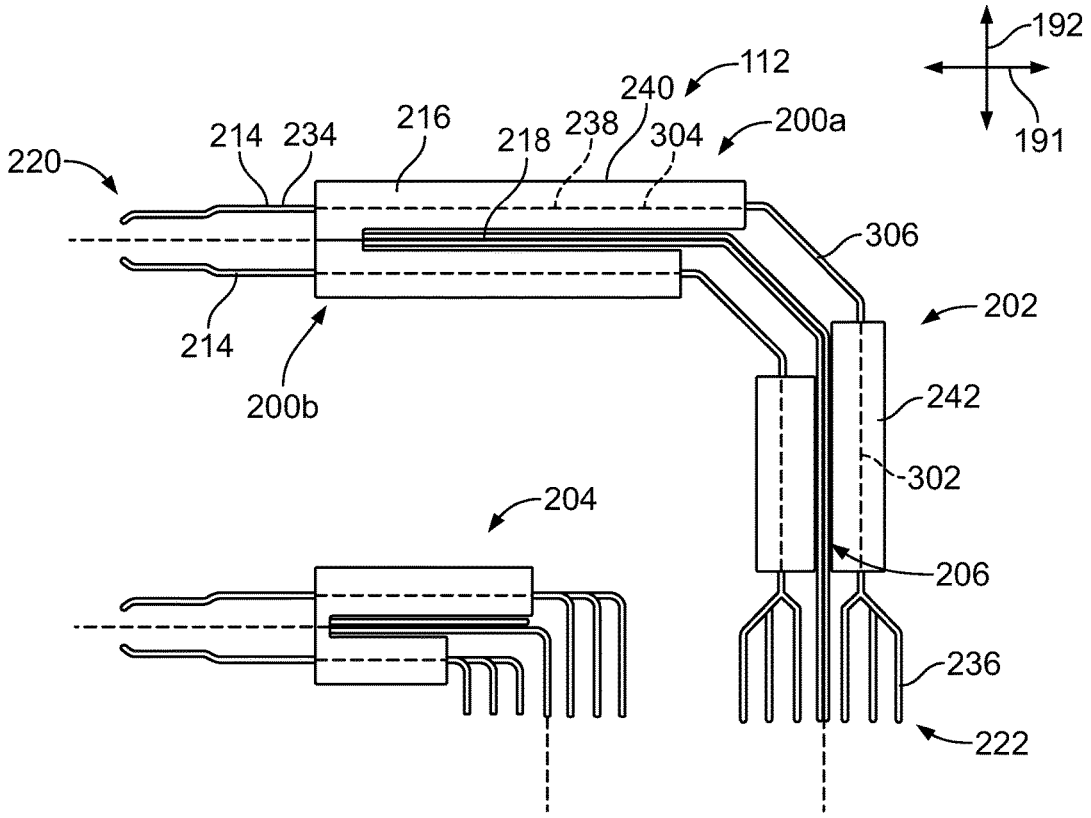
FIG. 4 is a side view of a portion of the electrical connector in accordance with an exemplary embodiment.
Figure 5:
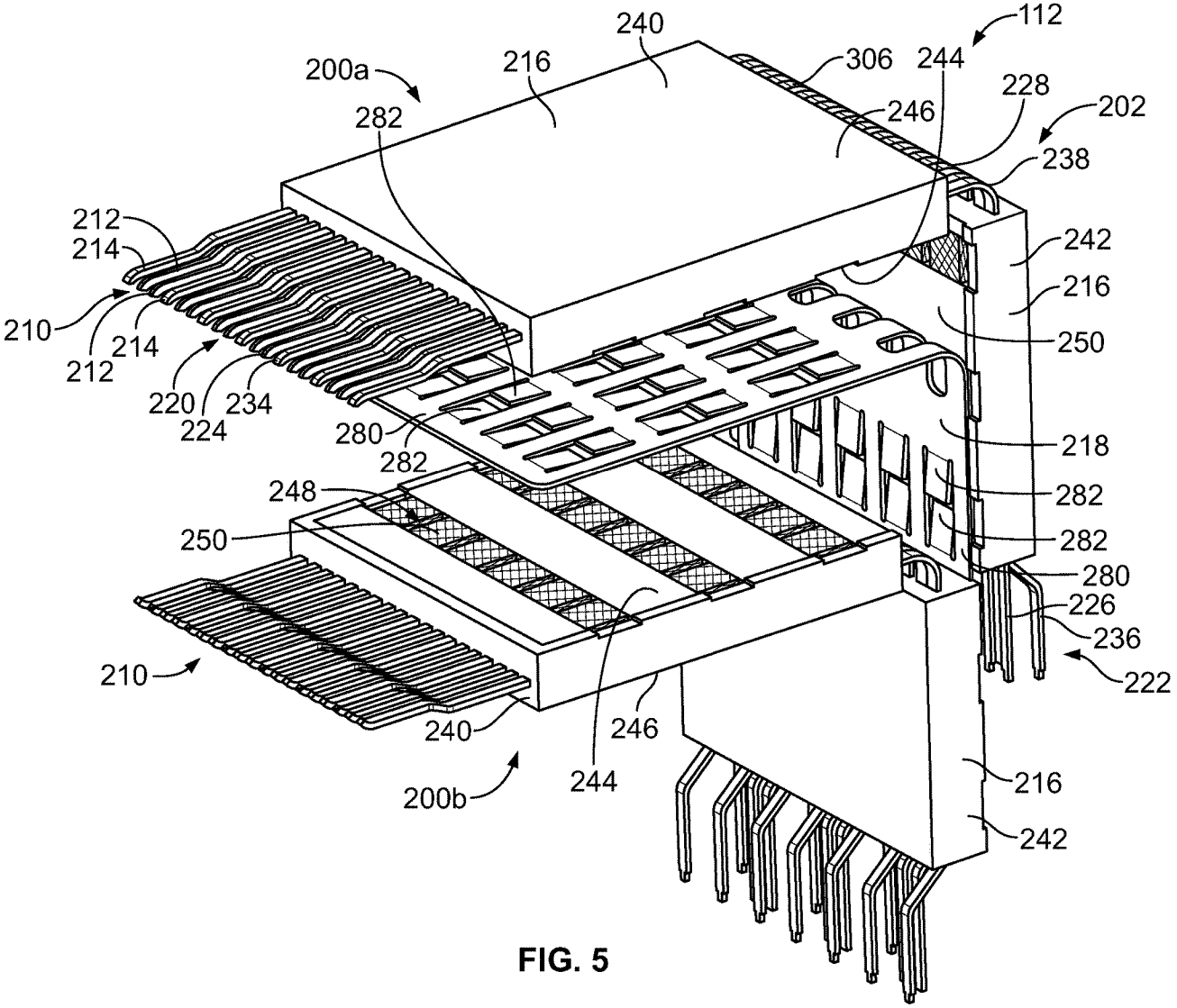
FIG. 5 is an exploded, perspective view of a portion of the electrical connector in accordance with an exemplary embodiment.

FIG. 3 is a perspective view of a portion of the electrical connector 112 in accordance with an exemplary embodiment showing lead frame modules 200 thereof. FIG. 4 is a side view of a portion of the electrical connector 112 in accordance with an exemplary embodiment showing lead frame modules 200 thereof. FIG. 5 is an exploded, perspective view of a portion of the electrical connector 112 in accordance with an exemplary embodiment showing lead frame modules 200 thereof. FIGS. 3-5 illustrate the electrical connector 112 with the housing 160 (shown in FIG. 1) omitted to show various lead frame modules 200 of the electrical connector 112. FIGS. 3 and 4 illustrate the electrical connector 112 including four lead frame modules 200 organized into a first module assembly 202 and a second module assembly 204. However, FIG. 5 only illustrates the first module assembly 202.

In an exemplary embodiment, each of the module assemblies 202, 204 includes two lead frame modules 200 stacked together to form the corresponding module assemblies 202, 204; however, the module assemblies 204 may include greater or fewer lead frame modules 200 in alternative embodiments. In an exemplary embodiment, the first module assembly 202 is spaced apart from the second module assembly 204 and configured to be separately held in the housing 160 in a spaced apart arrangement; however, the first and second module assemblies 202, 204 may be stacked adjacent each other in alternative embodiments and may be stacked with additional module assemblies in other various embodiments. The first module assembly 202 aligns with the upper shroud 170 (FIG. 2) of the housing 160 and the second module assembly 204 aligns with the lower shroud 172 (FIG. 2) of the housing 160.

The first and second module assemblies 202, 204 are oriented with respect to a longitudinal or depth axis 191, a vertical axis 192, and a lateral axis 193. The axes 191-193 are mutually perpendicular. Although the vertical axis 192 appears to extend in a vertical direction parallel to gravity in FIG. 2, it is understood that the axes 191-193 are not required to have any particular orientation with respect to gravity. The first module assembly 202 is taller (e.g., along the vertical axis 192) and defines longer conductive signal paths than the second module assembly 204. The first and second module assemblies 202, 204 may be similar and include similar features. The description below is in reference to the first module assembly 202; however, the features of the first module assembly 202 may be applicable to the second module assembly 204, although the components may have different physical dimensions and/or orientations.

The first module assembly 202 includes a first or upper lead frame module 200*a* and a second or lower lead frame module 200*b*. The upper and lower lead frame modules 200*a*, 200*b* are disposed along opposite sides of a respective module interface 206 (FIG. 4). The upper and lower lead frame modules 200*a*, 200*b* engage each other at the module interface 206 to electrically connect the first and second lead frame modules 200*a*, 200*b*. The upper and lower lead frame modules 200*a*, 200*b* each include a respective lead frame 210 having signal conductors 212 and ground conductors 214 and a respective dielectric holder 216 holding the lead frame 210. The signal conductors 212 and the ground conductors 214 are interleaved and disposed side-by-side along the lateral axis 193. For example, in an exemplary embodiment, the signal conductors 212 are arranged in pairs as differential pairs and the ground conductors 214 are interspersed between the pairs of signal conductors 212 in a ground-signal-signal-ground arrangement. Other arrangements are possible in alternative embodiments. The dielectric holder 216 at least partially surrounds the signal conductors 212 and the ground conductors 214 to secure the positions of the signal conductors 212 and the ground conductors 214.

In an exemplary embodiment, the lead frame modules 200*a*, 200*b* include respective printed metal layers 250 on the dielectric holders 216. The printed metal layers 250 are electrically connected to the ground conductors 214 to electrically common the ground conductors 214. The printed metal layers 250 may be on one or both sides of the dielectric holders 216. The printed metal layers 250 provides shielding between the signal conductors 212 of the upper and lower lead frame modules 200*a*, 200*b* on either side thereof, such as to block cross-talk and other electrical interference between the signal conductors 212 of the upper and lower lead frame modules 200*a*, 200*b*.

In an exemplary embodiment, the first module assembly 202 includes a ground plate 218 along the module interface 206. The ground plate 218 is configured to be electrically connected to the printed metal layers 250 and thus to the ground conductors 214. The ground plate 218 electrically connects the upper and lower lead frame modules 200*a*, 200*b*. The ground plate 218 provides shielding between the signal conductors 212 of the upper and lower lead frame modules 200*a*, 200*b* on either side thereof, such as to block cross-talk and other electrical interference between the signal conductors 212 of the upper and lower lead frame modules 200*a*, 200*b*.

Each of the lead frame modules 200*a*, 200*b* extends from a mating end 220 to a terminating end 222. The ground conductors 214 and the signal conductors 212 extend continuously from the mating end 220 to the terminating end 222. The signal conductors 212 include mating ends 224 defined by mating contacts at the mating end 220 that are configured to engage the mating electrical components, such as the circuit cards of the pluggable modules 106 (FIG. 1) within the upper shroud 170 (FIG. 2). The signal conductors 212 also include terminating ends 226 defined by contact tails at the terminating end 222 configured to be surface mounted or thru-hole mounted to the host circuit board 102 (FIG. 1). For example, the terminating ends 226 may be posts for thru-hole mounting, bent tips for surface mounting, or the like. The signal conductors 212 include transition portions 228 extending between the mating ends 224 and the terminating ends 226.

The ground conductors 214 also include mating ends 234 at the mating end 220 and terminating ends 236 at the terminating end 222. The ground conductors 214 include transition portions 238 (shown in phantom in FIG. 4) extending between the mating ends 234 and the terminating ends 236. The mating ends 234 may be similar in size, shape, and positioning to the mating ends 224 of the signal conductors 212. The terminating ends 236 may be similar in size and shape to the terminating ends 226 of the signal conductors 212. In the illustrated embodiment, the terminating ends 236 of the ground conductors 214 are offset positionally from the terminating ends 226 of the signal conductors 212, which may be based on the circuit layout of the host circuit board 102.

The mating ends 224, 234 of each lead frame module 200 project beyond a front edge of the dielectric holder 216 to the mating end 220. In the illustrated embodiment, the upper module assembly 202 is a dual row module assembly, with each of the two lead frame modules 200 thereof defining one of the two rows. For example, the mating ends 224, 234 of each lead frame module 200 are arranged in-line along a row that is parallel to the lateral axis 193. The row defined by the mating ends 224, 234 of the upper lead frame module 200*a* is a top row within the upper shroud 170 (FIG. 2) of the housing 160 (FIG. 2). The top row is configured to engage a first or upper side of the mating electrical component that is loaded into the upper shroud 170. The mating ends 224, 234 of the second lead frame module 200*b* define a bottom row within the upper shroud 170 that is configured to engage a second or lower side of the same mating electrical component. Other arrangements of the mating ends 224, 234 are possible in alternative embodiments.

In an exemplary embodiment, the dielectric holder 216 is manufactured from a dielectric material, such as plastic material. In various embodiments, the dielectric holder 216 includes an overmold body overmolded (formed in situ on) onto the lead frame 210. For example, the dielectric holder 216 encases at least a portion of the transition portion 228 of each signal conductor 212 and encases at least a portion of the transition portion 238 of each ground conductor 214. The dielectric holder 216 is elongated laterally (e.g., parallel to the lateral axis 193) to engage and hold each of the signal conductors 212 and each of the ground conductors 214 within the lead frame module 200. In the illustrated embodiment, the dielectric holder 216 is a split dielectric holder having multiple separate and discrete pieces. For example, in the illustrated embodiment, the dielectric holder 216 includes a first holder member 240 and a second holder member 242 spaced apart from the first holder member 240 along the length of the lead frame 210. The first holder member 240 is elongated laterally and longitudinally (e.g., along the longitudinal axis 191), and are relatively thin or narrow along the vertical axis 192. The second holder member 242 is elongated laterally and vertically (e.g., along the vertical axis 192), and are relatively thin or narrow along the longitudinal axis 191.

The dielectric holder 216 supports the lead frame 210. The dielectric holder 216 at least partially surrounds the transition portions 238 of the ground conductors 214 and at least partially surrounds the transition portions 228 of the signal conductors 212. The dielectric holder 216 has a first side 244 and a second side 246 opposite the first side 244. The first side 244 defines an inner side and faces the adjacent lead frame module 200. For example, the upper lead frame module 200*a* is oriented with the first side 244 facing inward (downward), such as facing the lower lead frame module 200*b* and the lower lead frame module 200*b* is oriented with the first side 244 facing outward (upward), such as facing the upper lead frame module 200*a*. The first sides 244 face the ground plate 218. The printed metal layers 250 are provided on the first sides 244 of the lead frame modules 200*a*, 200*b* to electrically connect with the ground plate 218.

In an exemplary embodiment, the first side 244 of each lead frame module 200 has wells 248 (FIG. 5) open to the transition portions 238 of the ground conductors 214. The printed metal layer 250 is formed in situ on the first side 244 of the dielectric holder 216 and at least partially fills the wells 248 to engage the ground conductors 214. The printed metal layer 250 is electrically connected to the corresponding ground conductors 214 in the wells 248. Optionally, the printed metal layer 250 is electrically connected to each of the ground conductors 214 within the lead frame 210 to electrically common each of the ground conductors 214. In an exemplary embodiment, the ground conductors 214 are electrically connected by the printed metal layer(s) 250 at multiple locations along the lengths of the ground conductors 214, such as less than every 3.0 mm apart. The spacing or distance between the connection points with the printed metal layer(s) 250 may affect the electrical characteristics of the shielding structure, such as the shielding frequency.

The module assembly 202, in the illustrated embodiment, has a right angle configuration. The module interface 206 follows the right angle configuration. The ground plate 218 follows the right angle configuration. The signal conductors 212 and the ground conductors 214 of the lead frame modules 200 define a vertical region 302 that extends generally parallel to the vertical axis 192, a horizontal region 304 that extends generally parallel to the longitudinal axis 191, and a bend region 306 disposed therebetween. The transition portions 228, 238 of the signal and ground conductors 212, 214 transition through the bend region 306 between the vertical region 302 and the horizontal region 304. The vertical region 302 may be oriented perpendicular to the horizontal region 304. The bend region 306 provides a generally right angle curve. In the illustrated embodiment, the bend region 306 is defined by curves in the signal conductors 212 and the ground conductors 214; however the bend region 306 may be defined by other shapes, such as two 45 degree angles, a single 90 degree curve, three 30 degree angles, or the like.

The first holder member 240 at least partially surrounds the signal conductors 212 and the ground conductors 214 along the horizontal region 304, and the second holder member 242 at least partially surrounds the signal conductors 212 and the ground conductors 214 along the vertical region 302. In the illustrated embodiment, the first and second holder members 240, 242 do not extend along the bend region 306. Rather, the signal conductors 212 and the ground conductors 214 are exposed between the first and second holder members 240, 242. In an alternative embodiment, the bend region 306 may be at least partially surrounded by the dielectric holder 216, such as the first holder member 240, the second holder member 242, or a discrete, third holder member (not shown).

Figure 6:
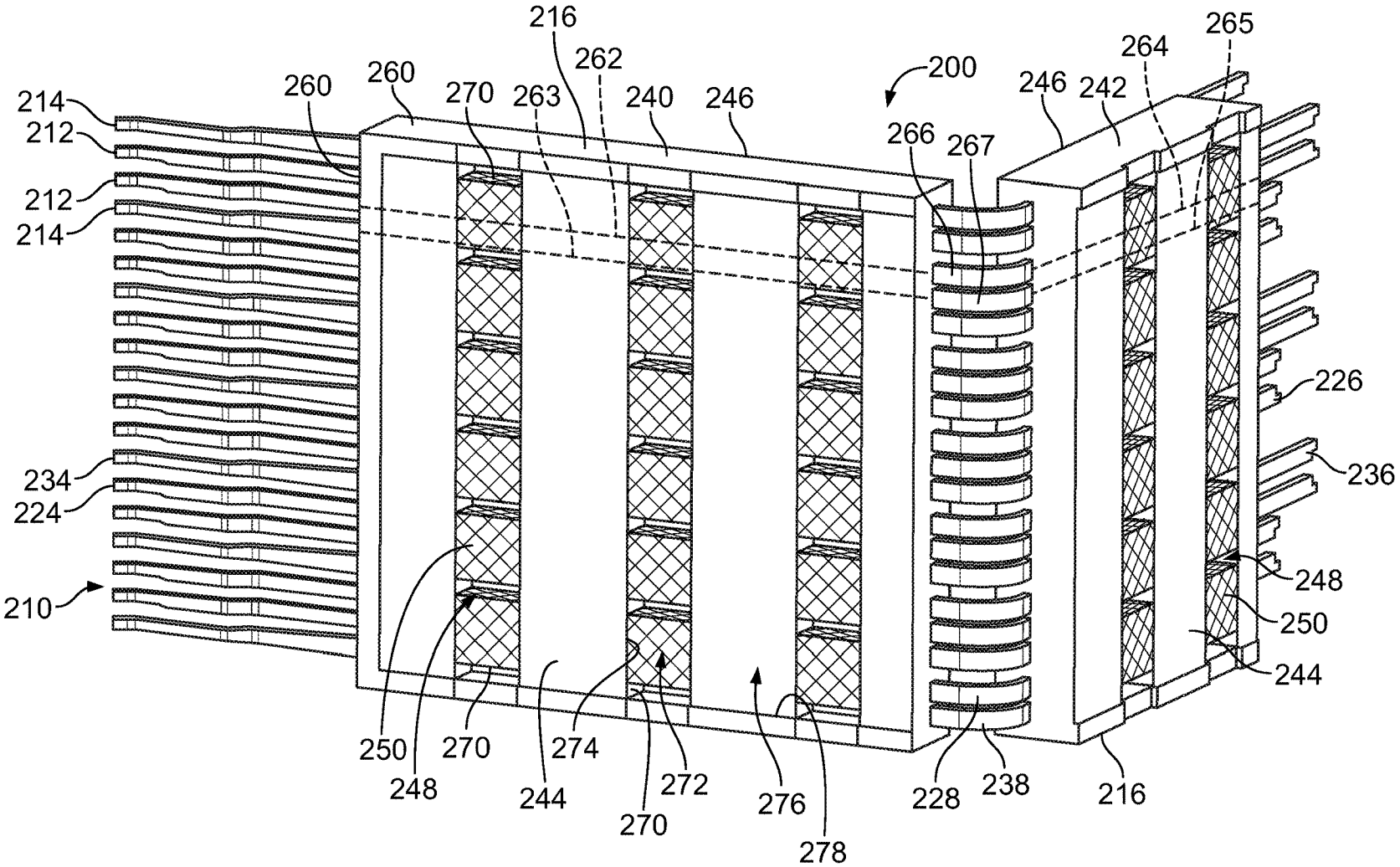
FIG. 6 is a perspective view of a lead frame module in accordance with an exemplary embodiment.

FIG. 6 is a perspective view of one of the lead frame modules 200 in accordance with an exemplary embodiment (for example, the lower lead frame module). The lead frame module 200 includes the signal conductors 212 and the ground conductors 214 of the lead frame 210. The dielectric holder 216 is overmolded over the lead frame 210. The holder members 240, 242 have edges 260 between the first and second sides 244, 246, such as at the front, the rear and the side edges therebetween or the top, the bottom and the side edges therebetween.

The mating ends 224, 234 and the terminating ends 226, 236 extend from corresponding edges 260, such as at the front and the bottom, respectively. The transition portions 228, 238 extend through the dielectric holder 216. For example, the transition portions 228 of the signal conductors 212 include first segments 262, second segments 264 and bend segments 266 therebetween. The first segments 262 are located in the first holder member 240 and the second segments 264 are located in the second holder member 242. In an exemplary embodiment, the first segments 262 are oriented perpendicular with respect to the second segments 264. The bend segments 266 extend between the first and second holder members 240, 242. The transition portions 238 of the ground conductors 214 include first segments 263, second segments 265 and bend segments 267 therebetween. The first segments 263 are located in the first holder member 240 and the second segments 265 are located in the second holder member 242. In an exemplary embodiment, the first segments 263 are oriented perpendicular with respect to the second segments 265. The bend segments 267 extend between the first and second holder members 240, 242.

The dielectric holder 216 includes the wells 248 in the first side 244 open to the transition portions 238 of the ground conductors 214. The printed metal layer 250 is formed in situ on the first side 244 of the dielectric holder 216 to at least partially fill the wells 248 and engage the ground conductors 214 and the wells 248 to electrically connect to the ground conductors 214. Optionally, the wells 248 may be entirely filled with the printed metal layer 250. In an exemplary embodiment, the first holder member 240 includes wells 248 and the second holder member 242 includes wells 248. In the illustrated embodiment, each transition portion 238 of each ground conductor 214 is exposed by multiple wells 248 in the first holder member 240 and in the second holder member 242. Optionally, the wells 248 may have a generally uniform spacing therebetween. The wells 248 are defined by well edges 270 extending into the dielectric holder 216. The printed metal layer 250 may engage one or more of the well edges 270. In various embodiments, the printed metal layer 250 engages all of the well edges 270. Optionally, the well edges 270 may be generally perpendicular to the first side 244. Alternatively, the well edges 270 may be angled non-perpendicular to the first side 244 to form the wells 248 as funnel shaped, being wider at the first side 244 and narrower at the ground conductors 214. In the illustrated embodiment, the wells 248 are generally rectangular in shape having a width approximately equal to the width of the transition portions 238. In other various embodiments, the wells 248 may be wider than the transition portions 238 exposing both the side and edges of the transition portions 238 within the wells 248.

In an exemplary embodiment, the dielectric holder 216 includes channels 272 formed in the first side 244 connecting corresponding wells 248. The channels 272 extend laterally across the dielectric holder 216. The channels 272 are defined by lips 274 such that the channels 272 are recessed in the first side 244. Optionally, the channels 272 may span across each of the ground conductors 214, such as substantially entirely across the dielectric holder 216. The channels 272 may be at least partially filled with the printed metal layer 250 to electrically connect the ground conductors 214. For example, the channels 272 may form a path or area for the printed metal layer 250 to be applied to the dielectric holder 216. For example, the printed metal layer 250 may be printed on the surfaces of the dielectric holder 216 defining the channels 272.

In an exemplary embodiment, the dielectric holder 216 includes a pocket 276 formed in the first side 244 connecting corresponding wells 248 and/or corresponding channels 272. The pocket 276 may cover a majority of the first side 244, such as substantially all of the first side 244. The pocket 276 is defined by lips 278 such that the pocket 276 is recessed in the first side 244. The lips 278 may be provided at the edges 260 of the dielectric holder 216. Optionally, the pocket 276 may span across each of the ground conductors 214, such as substantially entirely across the dielectric holder 216. The pocket 276 may be at least partially filled with the printed metal layer 250 to electrically connect the ground conductors 214. For example, the pocket 276 may form a path or area for the printed metal layer 250 to be applied to the dielectric holder 216. For example, the printed metal layer 250 may be printed on the surfaces of the dielectric holder 216 defining the pocket 276.

The printed metal layer 250 is formed in situ on the first side 244 of the dielectric holder 216 to electrically connect to a plurality of the ground conductors 214 exposed by the wells 248 formed in the first side 244. In various embodiments, a printed metal layer (not shown) may be formed on the second side 246 of the dielectric holder 216 in addition to the first side 244. The printed metal layer 250 is electrically conductive. The printed metal layer 250 includes metallic particles forming electrical conductors where applied. Optionally, the printed metal layer 250 may include nonmetallic particles, such as binder material for applying the printed metal layer 250 to the dielectric holder 216. The printed metal layer 250 is printed on the surfaces of the dielectric holder 216, such as the first side 244 and the well edges 270, as well as on the transition portions 238 of the ground conductors 214. For example, the printed metal layer 250 may be screen printed, inkjet printed, or otherwise applied to the dielectric holder 216. The printed metal layer 250 may be cured once applied to the dielectric holder 216. Optionally, the printed metal layer 250 may be built up by an additive process. Optionally, the printed metal layer 250 may be electroplated to enhance the electrical conductivity of the printed metal layer 250. In an exemplary embodiment, the printed metal layer 250 is selectively applied to the dielectric holder 216, such as in the wells 248 and in the channels 272. For example, the dielectric holder 216 may include separate tracks or lines of printed metal layers 250 each separate from each other but each electrically connecting a plurality of the ground conductors 214. In various embodiments, the printed metal layer 250 may entirely fill the wells 248 and/or the channels 272. Alternatively, the printed metal layer 250 may only partially fill the wells 248 and/or the channels 272, such as a thin layer. In other various embodiments, the printed metal layer 250 may be applied to the entire first side 244, such as to partially or entirely fill the pocket 276. The printed metal layer 250 electrically connects multiple ground conductors 214. In an exemplary embodiment, the printed metal layer 250 electrically connects all of the ground conductors 214. The printed metal layer 250 buses the ground conductors 214 together to connect the ground conductors 214 at the same electrical potential. The printed metal layer 250 may provide electrical shielding for the signal conductors 212, such as by covering some or all of the first side 244 of the dielectric holder 216.

Returning to FIG. 5, during assembly, the upper and lower lead frame modules 200*a*, 200*b* are coupled together with the ground plate 218 therebetween. The ground plate 218 is configured to be coupled to the first side 244 of the upper lead frame module 200*a* and is configured to be coupled to the first side 244 of the lower lead frame module 200*b*. The ground plate 218 includes a frame 280 and a plurality of spring members 282 extending from the frame 280. In an exemplary embodiment, the ground plate 218 is a stamped and formed plate with the spring members 282 being stamped out of the frame 280 and bent or deflected outward from the frame 280. In an exemplary embodiment, the spring members 282 extend in both directions from the frame 280 to engage both of the lead frame modules 200*a*, 200*b*. The spring members 282 are deflectable and configured to be spring biased against the lead frame modules 200*a*, 200*b*. For example, the spring members 282 engage corresponding portions of the printed metal layers 250 on the lead frame modules 200*a*, 200*b*.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A lead frame module of an electrical connector, the lead frame module comprising:

a lead frame including ground conductors and signal conductors interleaved with the ground conductors, the ground conductors and the signal conductors being disposed side-by-side, the ground conductors having transition portions extending between mating ends and terminating ends, the signal conductors having transition portions extending between mating ends and terminating ends; and a dielectric holder supporting the lead frame, the dielectric holder at least partially surrounding the transition portions of the ground conductors and at least partially surrounding the transition portions of the signal conductors, the dielectric holder having a first side and a second side, the first side having wells open to the transition portions of the ground conductors; and a printed metal layer formed in situ on the first side of the dielectric holder, the printed metal layer at least partially filling the wells and engaging the ground conductors in the wells to electrically connect to the ground conductors, the printed metal layer electrically connecting a plurality of the ground conductors.

2. The lead frame module of claim 1, wherein the printed metal layer electrically connects each of the ground conductors.

3. The lead frame module of claim 1, wherein the transition portion of each ground conductor is exposed by multiple wells.

4. The lead frame module of claim 1, wherein the wells are defined by well edges extending into the dielectric holder, the printed metal layer formed on the well edges.

5. The lead frame module of claim 1, wherein the wells are entirely filled with the printed metal layer.

6. The lead frame module of claim 1, wherein the dielectric holder includes channels formed in the first side connecting corresponding wells, the channels being at least partially filled with the printed metal layer to electrically connect the ground conductors.

7. The lead frame module of claim 1, wherein the dielectric holder includes a pocket formed in the first side covering a majority of the first side, the pocket being at least partially filled with the printed metal layer to electrically connect the ground conductors.

8. The lead frame module of claim 1, further comprising a ground plate coupled to the first side of the dielectric holder, the ground plate being electrically connected to the printed metal layer.

9. The lead frame module of claim 8, wherein the ground plate includes deflectable spring fingers being spring biased against the printed metal layer.

10. The lead frame module of claim 8, wherein the ground plate is located between the dielectric holder and a second dielectric holder, the ground plate being electrically connected to a second printed metal layer on the second dielectric holder.

11. The lead frame module of claim 1, wherein the transition portions of the ground and signal conductors include first segments and second segments with bend segments therebetween such that the first segments are perpendicular to the second segments, the dielectric holder at least partially covering the first segments and at least partially covering the second segments, the first segments of each of the ground conductors including at least one well, the second segments of each of the ground conductors including at least one well.

12. The lead frame module of claim 11, wherein the dielectric holder includes a first holder member on the first segments and a second holder member separate and discrete from the first holder member and on the second segments, the bend segments extending between the first and second holder members.

13. The lead frame module of claim 1, further comprising a second printed metal layer on the second side of the dielectric holder, the second printed metal layer at least partially filling second wells on the second side to engage and electrically connect to the ground conductors.

14. A module assembly of an electrical connector, the module assembly comprising:

an upper lead frame module including an upper lead frame, an upper dielectric holder holding the upper lead frame and an upper printed metal layer formed in situ on the upper dielectric holder, the upper lead frame including upper ground conductors and upper signal conductors interleaved with the upper ground conductors, the upper ground conductors and the upper signal conductors being disposed side-by-side, the upper ground conductors having transition portions extending between mating ends and terminating ends, the upper signal conductors having transition portions extending between mating ends and terminating ends, the upper dielectric holder having a first side and a second side, the first side having upper wells open to the transition portions of the upper ground conductors, the upper printed metal layer formed on the first side of the upper dielectric holder, the upper printed metal layer at least partially filling the wells and engaging the upper ground conductors in the wells to electrically connect to the upper ground conductors, the upper printed metal layer electrically connecting a plurality of the upper ground conductors; and a lower lead frame module including a lower lead frame, a lower dielectric holder holding the lower lead frame and a lower printed metal layer formed in situ on the lower dielectric holder, the lower lead frame including lower ground conductors and lower signal conductors interleaved with the lower ground conductors, the lower ground conductors and the lower signal conductors being disposed side-by-side, the lower ground conductors having transition portions extending between mating ends and terminating ends, the lower signal conductors having transition portions extending between mating ends and terminating ends, the lower dielectric holder having a first side and a second side, the first side having lower wells open to the transition portions of the lower ground conductors, the lower printed metal layer formed on the first side of the lower dielectric holder, the lower printed metal layer at least partially filling the wells and engaging the lower ground conductors in the wells to electrically connect to the lower ground conductors, the lower printed metal layer electrically connecting a plurality of the lower ground conductors;

wherein the first side of the upper dielectric holder faces the first side of the lower dielectric holder such that the upper printed metal layer faces the lower printed metal layer.

15. The module assembly of claim 14, wherein the upper printed metal layer electrically connects each of the upper ground conductors and the lower printed metal layer electrically connects each of the lower ground conductors.

16. The module assembly of claim 14, wherein the upper wells are entirely filled with the upper printed metal layer and the lower wells are entirely filled with the lower printed metal layer.

17. The module assembly of claim 14, further comprising a ground plate positioned between the upper lead frame module and the lower lead frame module, the ground plate being electrically connected to the upper printed metal layer and being electrically connected to the lower printed metal layer.

18. The lead frame module of claim 17, wherein the ground plate includes deflectable spring fingers being spring biased against the upper printed metal layer and the lower printed metal layer.

19. An electrical connector comprising:

a housing having a mating end, the housing having a slot at the mating end receiving a mating electrical component, the housing having a cavity; and a lead frame module received in the cavity, the lead frame module comprising:

a lead frame including ground conductors and signal conductors interleaved with the ground conductors, the ground conductors and the signal conductors being disposed side-by-side, the ground conductors having transition portions extending between mating ends and terminating ends, the signal conductors having transition portions extending between mating ends and terminating ends, the mating ends of the ground conductors and the mating ends of the signal contacts being positioned in the slot for mating with the mating electrical component; and a dielectric holder supporting the lead frame, the dielectric holder at least partially surrounding the transition portions of the ground conductors and at least partially surrounding the transition portions of the signal conductors, the dielectric holder having a first side and a second side, the first side having wells open to the transition portions of the ground conductors; and a printed metal layer formed in situ on the first side of the dielectric holder, the printed metal layer at least partially filling the wells and engaging the ground conductors in the wells to electrically connect to the ground conductors, the printed metal layer electrically connecting a plurality of the ground conductors.

20. The electrical connector of claim 19, further comprising a ground plate coupled to the first side of the dielectric holder, the ground plate being electrically connected to the printed metal layer.

* * * * *